US006811661B2

(12) United States Patent
Yamamoto

(10) Patent No.: US 6,811,661 B2
(45) Date of Patent: Nov. 2, 2004

(54) CATHODE CARTRIDGE OF TESTING DEVICE FOR ELECTROPLATING AND TESTING DEVICE FOR ELECTROPLATING

(75) Inventor: Wataru Yamamoto, Tokyo (JP)

(73) Assignee: Yamamoto-MS Co., Ltd., Tokyo (JP)

( * ) Notice: Subject to any disclaimer, the term of this patent is extended or adjusted under 35 U.S.C. 154(b) by 242 days.

(21) Appl. No.: 09/861,898

(22) Filed: May 22, 2001

(65) Prior Publication Data

US 2002/0008026 A1 Jan. 24, 2002

(30) Foreign Application Priority Data

May 24, 2000 (JP) ..... 2000-152342

(51) Int. Cl.[7] ..... C25D 17/06

(52) U.S. Cl. ..... 204/297.01; 204/286.1; 204/434

(58) Field of Search ..... 204/400, 434, 204/286.1, 297.01, 237, 290.01

(56) References Cited

U.S. PATENT DOCUMENTS 3,347,768 A * 10/1967 Clark et al. ..... 204/196.01
4,400,258 A * 8/1983 Hans-Jürgen et al. ..... 204/415
4,425,918 A * 1/1984 Moll et al. ..... 204/415
5,227,041 A * 7/1993 Brogden et al. ..... 204/297.05
5,744,019 A * 4/1998 Ang ..... 205/96
6,071,388 A * 6/2000 Uzoh ..... 204/297 R
6,540,899 B2 * 4/2003 Keigler ..... 205/118

FOREIGN PATENT DOCUMENTS

JP 02-194194 A * 7/1990 ..... C25D/7/12
JP 06-310461 A * 11/1994 ..... C25D/7/12
JP 08-311689 A * 11/1996 ..... C25D/7/12

* cited by examiner

*Primary Examiner*—Roy King
*Assistant Examiner*—Harry D Wilkins, III
(74) *Attorney, Agent, or Firm*—Liniak, Berenato & White

(57) ABSTRACT

A cathode cartridge of a testing device for electroplating is provided, and includes a dummy plate 7 as a negative pole provided outside a tabular front insulator 6. The dummy plate includes an orifice a having the same shape as a plated part 2*a* of a plated base 2 as a negative plate. Protruding portions 4 press contact to a peripheral part of the plated base 2*a*. A tabular cathode conductor 4 connects with a direct voltage source not soaked in a plating solvent. A tabular rear insulator 5 covers rear sides of the plated base 2 and the cathode conductor 4, and has a recess, into which the plated base 2 and the cathode conductor 4 are retained. A tabular front insulator 6 having an orifice having the same shape as the plated base 2*a* covers a front side of the cathode conductor 4. An elastic thin board 9 is sandwiched between the plate base 2 and the tabular front insulator.

5 Claims, 10 Drawing Sheets

CATHODE CARTRIDGE OF TESTING DEVICE FOR ELECTROPLATING AND TESTING DEVICE FOR ELECTROPLATING

BACKGROUND OF THE INVENTION

1. Field of the Invention

The present invention relates to a cathode cartridge of a testing device for electroplating, and to a testing device for electroplating, more particularly to one that can plate uniformly.

2. Prior Art

Recently, plating technology has been applied in a wide range of fields, and has been especially noticed as a technology for forming a minute metallic object.

One these fields is the wiring technology of LSI, which is the so-called Damascene Process. In order to materialize higher integration and high performance thereof, reducing a pitch of wiring distributed on a semiconductor is required. The Damascene Process is a method in which channels for wiring are maintained after setting up layer insulation by carrying cut a dry etching process and then the wiring material is bedded in said channel by plating.

Moreover, as the latest technique of using another plating technology, there is a technique called as LIGA (Lithographie, Galvanoformung devices) to manufacture minute mechanical parts. LIGA is a technology by which acrylic resin is treated by X-ray, which is to be performed as molding processing, and then metallic minute particles are molded out of accumulating plating deposit thickly in the mold.

In order to materialize said plating technology, accumulating with uniform plating is required for a hollow dug place of a plating material. In addition, an appropriate plating condition is chosen by carrying out tests under any kind of conditions of plating solution and current density in a small scale laboratory level to be industrialized.

An object of the present invention is to provide a cathode cartridge and anode cartridge of a testing device for electroplating and a testing device for electroplating which can farm uniform film in a small scale testing device for electroplating.

SUMMARY OF THE INVENTION

To solve said objects, according to the primary object of the present invention, there is provided a cathode cartridge used in a testing device for electroplating, which comprises:

- a tabular cathode conductor, which has an orifice having the same shape as a plated part of a plated base; the cathode conductor having a plurality of protruding portions that press contact to a peripheral part around the plated part, and which is able to connect with a direct current power supply by an exposed portion thereof not soaked in plating solution,
- a tabular rear insulator covering both a backside of the plated base and a backside of the cathode conductor, and having a recess into which the plated base and the cathode conductor are retained,
- a tabular front insulator having an orifice having the same shape as the plated part the front insulator covering a front side of the cathode conductor, and
- an elastic thin board sandwiched between the plated base and the tabular rear insulator.

Owing to the above mentioned construction, because the cathode part can be intercepted by the invading plating solution, lines of electric force are generated between the anode and the plated base. Consequently a uniform plating membrane can be formed. And owing to the construction, in which protruding portions provided in a cathode conductor press contact to the plated base, accurate contacting of the cathode conductor with the plated base can be obtained. Moreover, since multiple protruding portions are provided, the lines of electric force can enter uniformly into the plated base, and a uniform plating membrane can be formed. The conductor in the present invention is an electric conductor which means a metal or a carbon, for example.

According to the second object of the present invention, there is characterized the above-described cathode cartridge to be connected with a direct voltage source by providing a conductive dummy plate having said shaped orifice to be a negative pole.

Owing to above construction, since the lines of electric force limited to only around the plate base can enter into the dummy pate from a plate side of the plated base, the lines of electric force entering into the plated base can be uniform. Consequently, a uniform plating membrane can be formed.

Furthermore, according to the third object of the present invention, there is characterized a testing device for electroplating, which comprises:

- a plating tank containing plating solvent,
- an anode provided in said plating tank,
- a cathode which is the plated base provided in the plating tank and arranged parallel to said anode,
- a scupper for the plating solvent provided on a bottom surface of said plating tank, and
- exhaust holes for a plating solution provided on the bottom surface of the plating tank to circulate plating solvent around a surface of said plated base,
- wherein a circulation pump is connected with the testing device in order to absorb the plating solvent from said scupper and to blow up the plating solvent from the exhaust holes.

Owing to above construction bubbles generated on the plating part can be removed and the density of positive ion around the plating part can be invariable. Consequently a uniform plating membrane an be formed.

BRIEF DESCRIPTION OF THE DRAWINGS

FIG. 5(*b*) is a sectional view taken or line C—C of FIG. 4.

FIG. 8(*b*) is a sectional view taken on line F—F of FIG. 7(*a*) without a dummy plate.

FIG. 9(*b*) is a sectional view taken on line E—E of FIG. 9(*a*).

DESCRIPTION OF THE PREFERRED EMBODIMENT

Figure 1:
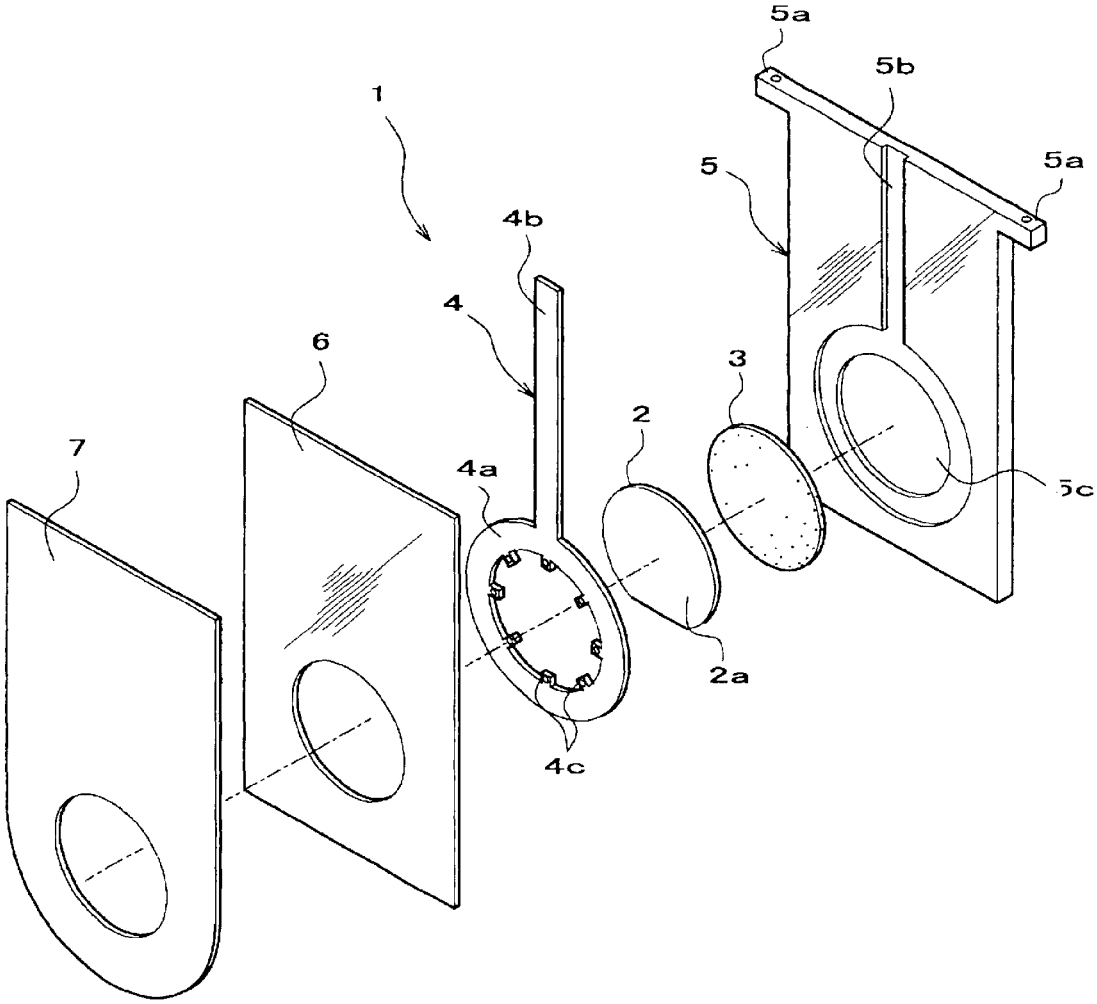
FIG. 1 is an exploded perspective view of the testing device for electroplating in accordance with the illustrated embodiment of this invention and a silicon wafer, FIG. 2(*a*) is a front view of the cathode cartridge of the testing device for electroplating according to the illustrated embodiment of this invention and a silicon wafer, FIG. 2(*b*) is a sectional view taken on line A—A of FIG. 2(*a*).
Figure 2A:
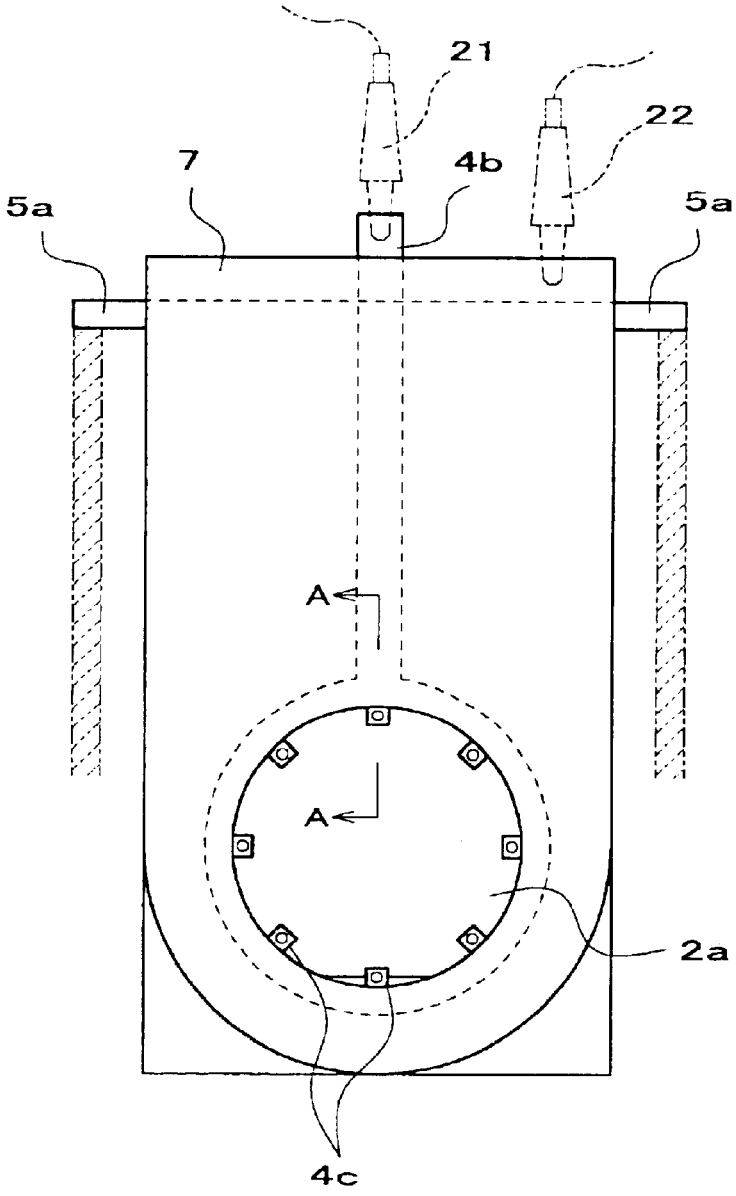
Figure 2B:
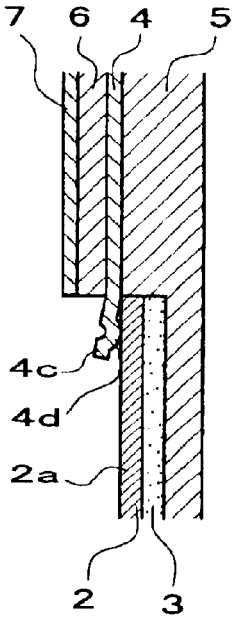

FIG. 1 is an exploded perspective drawing of a cathode cartridge of a testing device for electroplating in accordance with an illustrated embodiment of this invention and a silicon wafer. FIG. 2(*a*) is a top view of the cathode cartridge of the testing device for electroplating in accordance with the illustrated embodiment of this invention and a silicon wafer. FIG. 2(*b*) is a sectional view taken on line A—A of FIG. 2(*a*).

A cathode cartridge 1 has the following construction. An elastic thin board 3, which is rubber having elasticity, is absolutely contacted with a backside of a plated part (also referred to herein as a department) 2*a* so as to be intercepted by the invading plating solution. The elastic thin board 3 is arranged in the direction of the reverse (called "a back side" below) relative to a plated department (part) 2 of a circular thin board that is the plated base. A cathode conductor 4 comprised of ii stainless thin boat A is arranged on the side of the plated base 2*a* (called "a front side" below) of a silicon wafer 2. The cathode conductor 4 is comprised of a ring portion 4*a* having a circular shaped orifice that is almost the same shape as the outline of a plated department, a power supply-connecting department 4*b* protruded upward over the ring portion 4*a*, and contact flakes 4*c* provided toward a center at eight regular intervals around a circumference of the ring portion 4*a*. The contact flakes 4*c* have, moreover, as illustrating FIG. 2(*b*) a protruding portion 4*d* protruding toward the plate department 2*a*, and is press contacted to the plating department 2*a* with slightly distorting.

The rear side of the elastic thin board 3 and the cathode conductor 4 are covered with a rear side of an insulator 5 of an acryl plate. The rear side of the insulator 5 has a support portion 5*a* on the two upper apexes of its rectangular shape to hang the cathode cartridge 1 on the plating tank. Concave portions 5*b*, 5*c* are provided in the surface in which the cathode conductor 4 and the elastic thin board 3 are contacted with each other in order to enclose these parts.

A front side insulator 6 has an orifice that is the name shape as the outline of the plate department 2*a*, and is provided in the front side of the cathode conductor 4. At the same time, a dummy plate 7 comprised of an electric conductor which has an orifice that is the same shape as the outline of the plate department 2*a* is provided in the front side therein. The silicon wafer 2, the elastic thin board 3 and the cathode conductor 4 are sandwiched among the back side insulator 5, the front side insulator 6 and the dummy plate 7, and tight fixed together by using resin made screw (not illustrated) from the front side of the dummy plate 7. The cathode cartridge 1 and silicon wafer 2 (simply called "negative pole" below) are combined together, and have an appearance as shown in FIG. 2(*a*), when viewed through from the plating department side 2*a*, in which only the plating department 2*a* and the supply-connecting department 4*b* are exposed to sight from a front side of the cathode cartridge 1 and a rear side of insulator parts.

Figure 3:
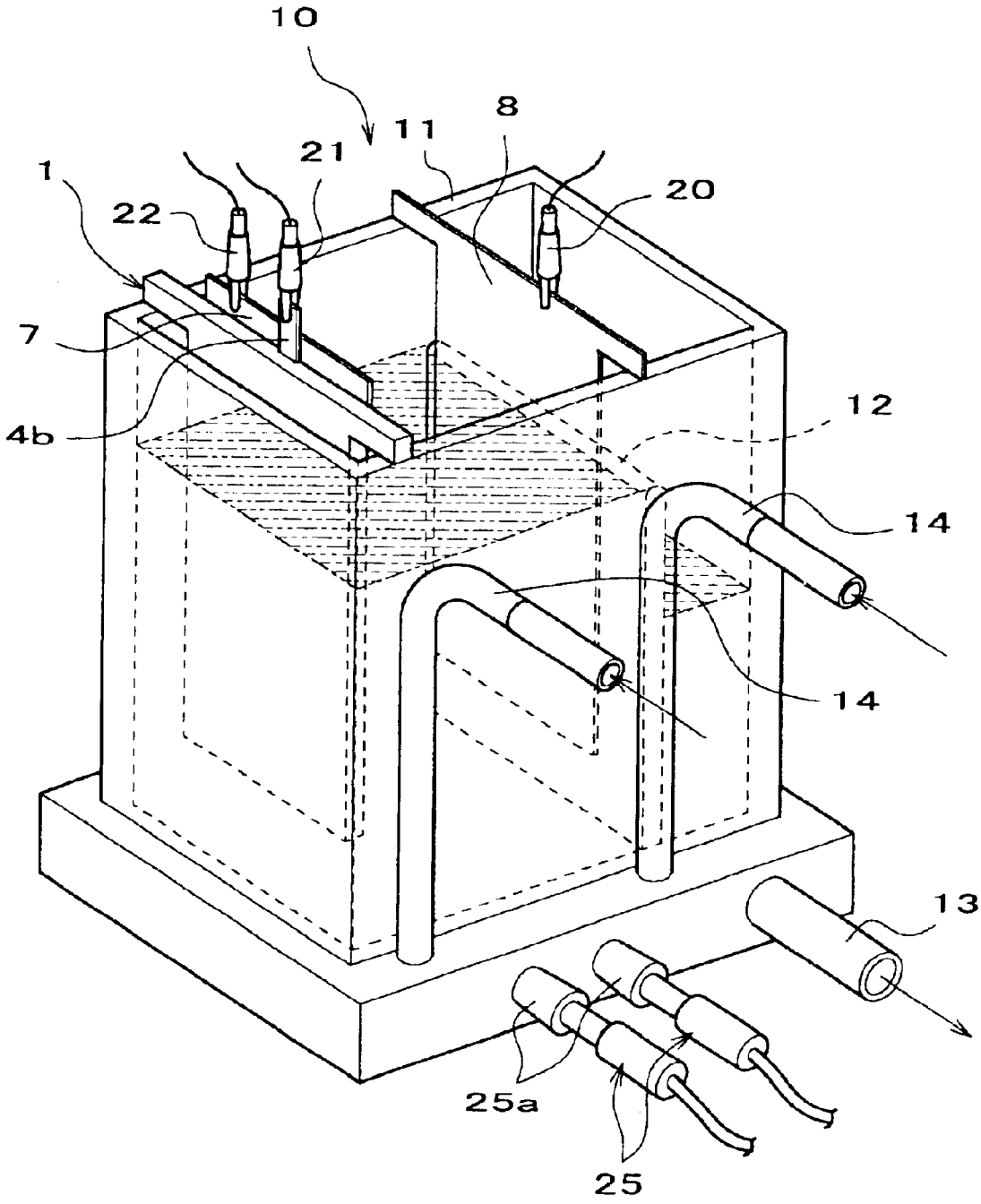
FIG. 3 is a perspective view of the testing device or electroplating according to the illustrated embodiment of this invention.
Figure 4:
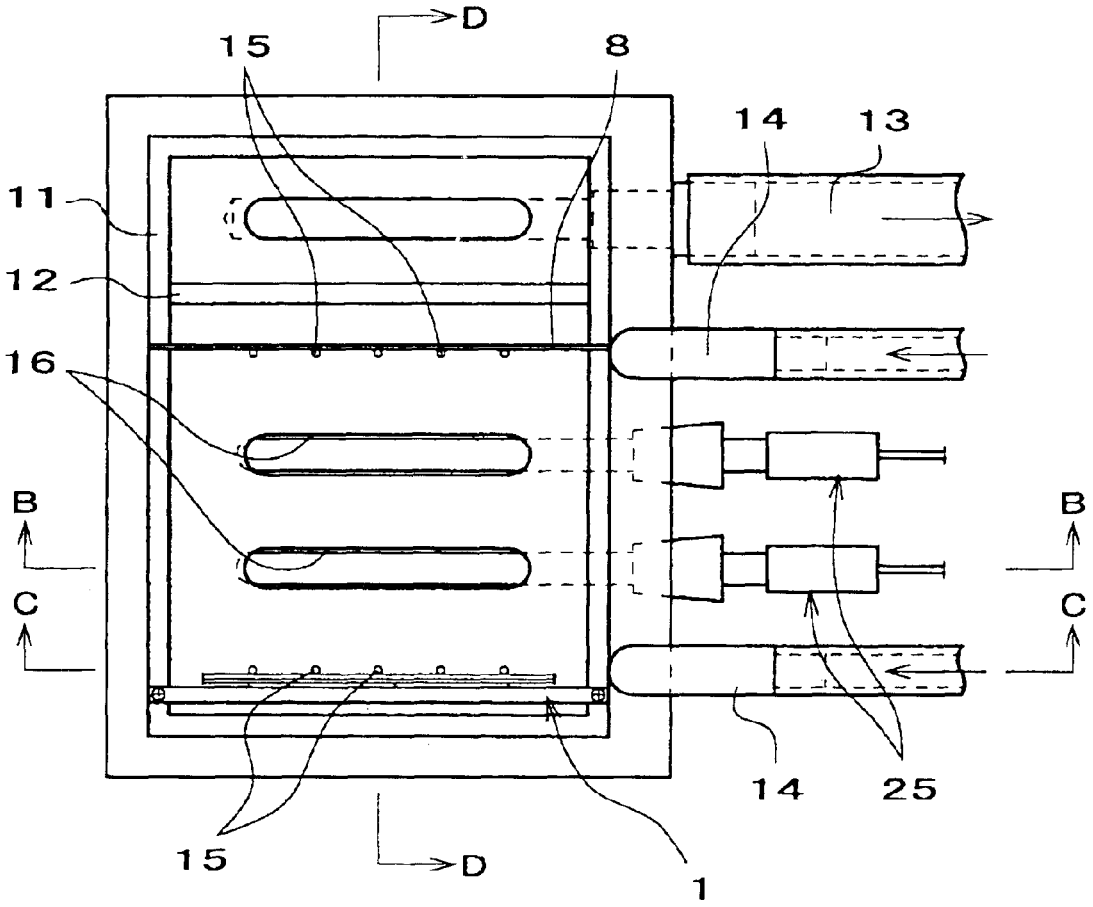
FIG. 4 is a top view of the testing device for electroplating according to the illustrated embodiment of this invention.
Figure 5A:
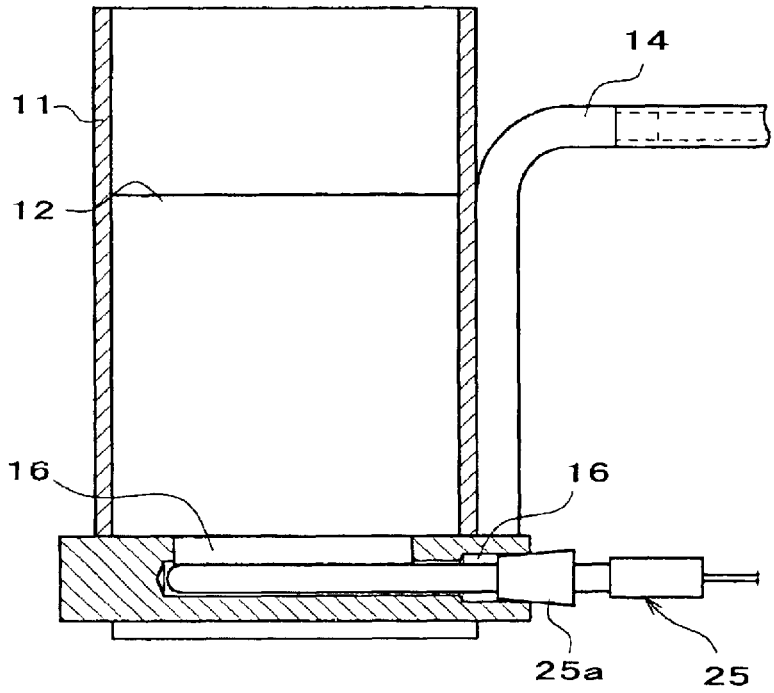
FIG. 5(*a*) is a sectional view taken on line of B—B of the testing device for electroplating regarding to the illustrated embodiment of this invention.
Figure 5B:
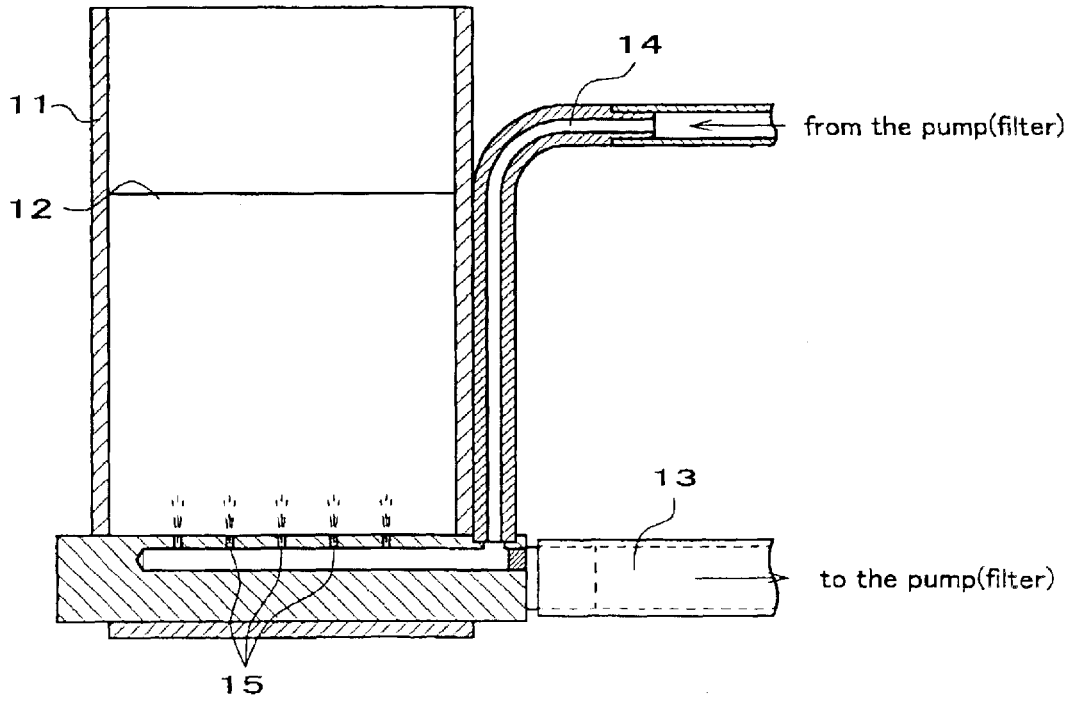
Figure 6:
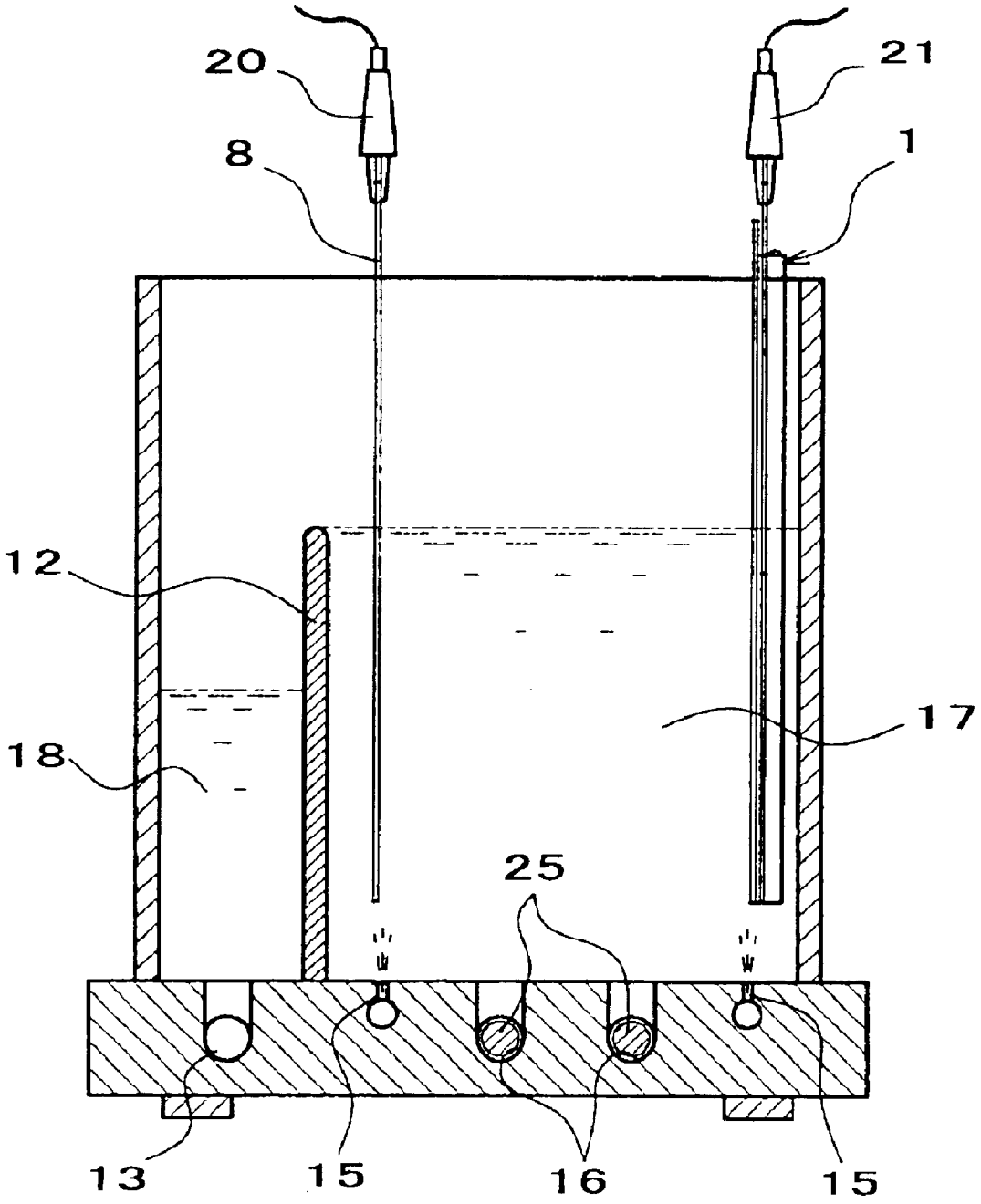
FIG. 6 is a sectional view taken on line D—D of FIG. 4 of the testing device for electroplating according to the illustrated embodiment of this invention, FIG. 7(*a*) is atop view of the cathode cartridge regarding to this invention, FIG. 7(*b*) is a top view of the cathode cartridge without a protruding portion.

FIG. 3 is a perspective drawing depicting the appearance of the testing device 1 for electroplating. The testing device 1 includes the negative pole 1 and a positive pole 8, and an installed power source, a pump and a heater. In FIG. 3, the illustration of a power source and rump are omitted. FIG. 4 is a top view of the testing device for electroplating in accordance with the illustrated embodiment of this invention. FIG. 5(*a*) is a sectional view taken on line B—B of FIG. 4 of the testing device for electroplating regarding to the illustrated embodiment of this invention. FIG. 5(*b*) a sectional view taken en line C–C of FIG. 4, and FIG. 6 is a sectional view taken on line D—D of FIG. 4.

The testing device for electroplating 10 is compared of a plating tank 11, the negative pole 1, a positive pole 8, a heater 25, and both a circulation pump and a power source. (See FIG. 3.)

The plating tank 11 is a water tank, which consists of a transparent acrylic plate and in which there is a plating tank 17 and a water tank 18 divided by a diaphragm 12, in which the former is larger in capacity than the latter. (See FIG. 6.) The negative pole 1 is placed by hanging the supporting portion 5*a* on the edge of the tank of the wall facing the diaphragm 12 of the plating tank 17. The positive pole 8 is, like a negative pole, placed by hanging the supporting portion 5*a* on the edge of the tank facing negative pole 1 on the side of the diaphragm 12. A heater 25 is inserted into a hole 16 (see to FIG. 5(*a*)) with a certain depth provided from a side position of a bottom of the plating tank 11. Besides, the entrance hole 16 for a heater is to prevent a leakage of the solvent enclosed by a rubber cook 25*a*.

The circulating pump (not illustrated) is connected to absorb the plating solvent from a drainage hole 13 provided from a side position of a bottom of the drainage tank 18, and to send the plating solvent into the inside of the plating tank 11 from an exhaust hole 14. The power source (not illustrated) has a positive pole connected to a positive pole 8 by terminal 20, and a negative pole connected to a power connecting source portion 4*b* by terminal 21 and a dummy plate 7 by a terminal 22.

The plating solvent including positive ions such as copper ions and so forth is poured in the plating tank 11. The plating solvent overflowed from the plating tank 17 flows into the drainage tank 18 try crossing over the diaphragm 12.

As illustrated in FIG. 5(*b*), the plating solvent entering from an inlet hole 14 is subject to be burst forth powerfully from exhaust nozzles 15 that are connected to the inflow hole 14. The exhaust nozzles 15 are, as indicated in FIG. 4 and FIG. 6, bored in the bottom of the plating tank 17, which are formed respectively in line at a near distance (approximately 1~2 mm) toward the plating department 2*a* of the negative pole 1 and the positive pole 8.

The cathode cartridge 1 of the testing device for electroplating, and the testing device for electroplating 10, which are constituted above, are operated in the following way. First, the plating solution is poured into the plating tank 11 to a level a little below the height of the diaphragm 12. And a circulation pump (not illustrated) is switched on. A positive pole of a power source is connected to terminal 20, and the negative pole of a power source is connected to terminal 21 and 22. At this time, a feeble current is fed in terminal 22 compared with terminal 21.

By the operations mentioned above, as the process for plating the silicon wafer 2 is started, the present invention produces the following actions in the plating process.

Figure 7A:
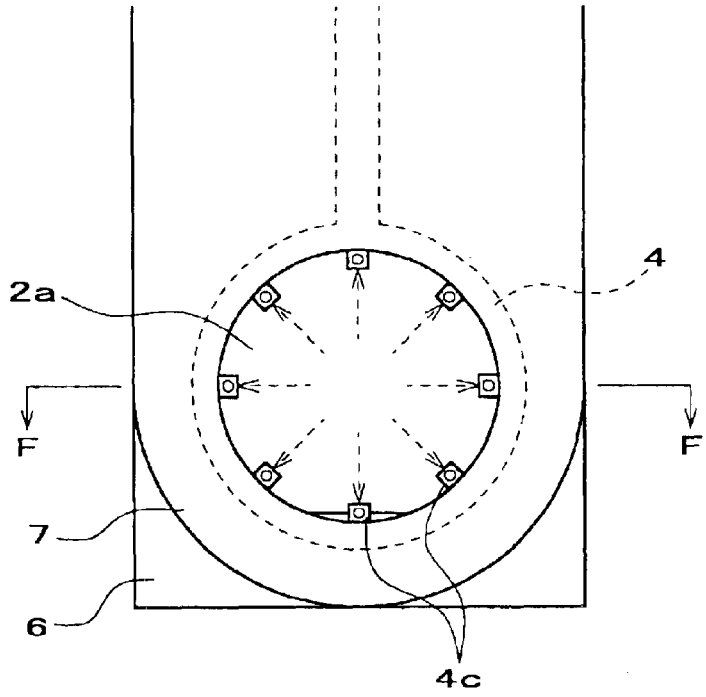
Figure 7B:
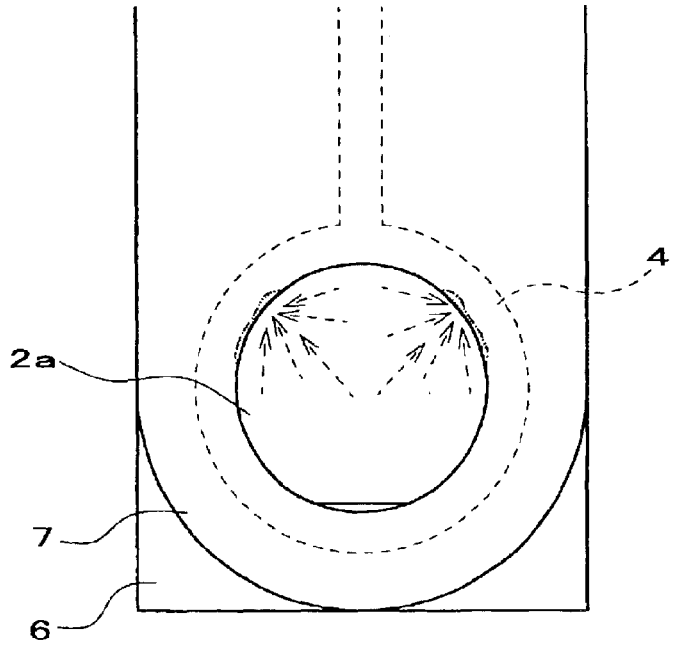

First of all, the following is a description of the contact between the plating department 2*a* and the cathode conductor 4. FIG. 7(*a*) is a top view of a cathode cartridge of the illustrated embodiment of the present invention, and FIG. 7(*b*) is a top view of a cathode cartridge without a protruding portion. In FIGS. 7(*a*) and 7(*b*), the arrows indicate flow of current on the plating department. When, contrary to the present invention, plating department 2*a* is contacted with a cathode conductor 4 on a peripheral part around the plated department 2*a* without a protruding portion 4*d*, only one pointed contact occurs on a circumference, as indicating in FIG. 7(*b*), due to a slight deformation of parts and unevenness of assembled parts. Consequently, since the lines of electric force eccentrically enter into/around the contacting point of the plating department, only the membrane around the contacting portion becomes thick, which is a heterogeneity as whole. However, in the present invention, because a narrow point of a tip of a protruding portion 4*d* contacts the plating department, the pressure on the contacting surface is high, and an accurate contact is guaranteed. In the illustrated embodiment of the present invention, a protruding portion 4*d* is contacted with the plate department 2*a* with distortion as indicating in FIG. 2(*b*), and the cathode conductor 4 is certain to contact the eight tips of circumference of the plate department 2*a*. Accordingly, as illustrated in FIG. 7(*a*), the lines of electric force uniformly enter into the plating department 2*a*, the current passes equally into each contact; and consequently, the formation of a uniform plating membrane is feasible.

In the present embodiment, by treating a protruding portion 4*d* of a contact flake 4*c* as a contact point and by providing contract flakes 4*c* around the inner circumference of the ring portion 4*a* of the cathode conductor 4, it is feasible to provide, for example protruding portions 4*d* around the ring portion 4*a* without a contact point 4*c*. In this case, the contact pressure of a contact point can be obtained by an elastic force of an elastic thin board 3.

The following is an explanation of providing a dummy plate 7 at the outside of the front side insulator 4 to make the dummy plate 7 a negative pole.

Figure 8A:
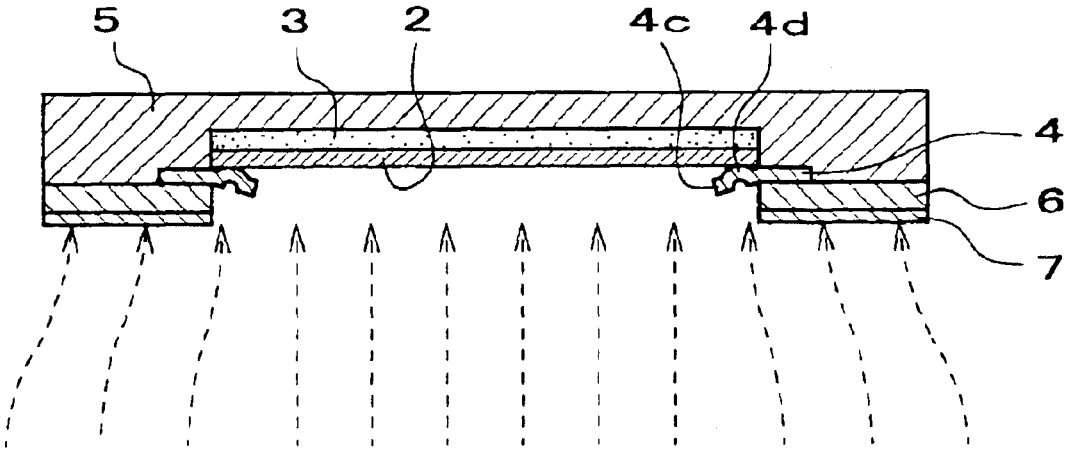
FIG. 8(*a*) is a sectional view taken on line F—F of FIG. 7(*a*).
Figure 8B:
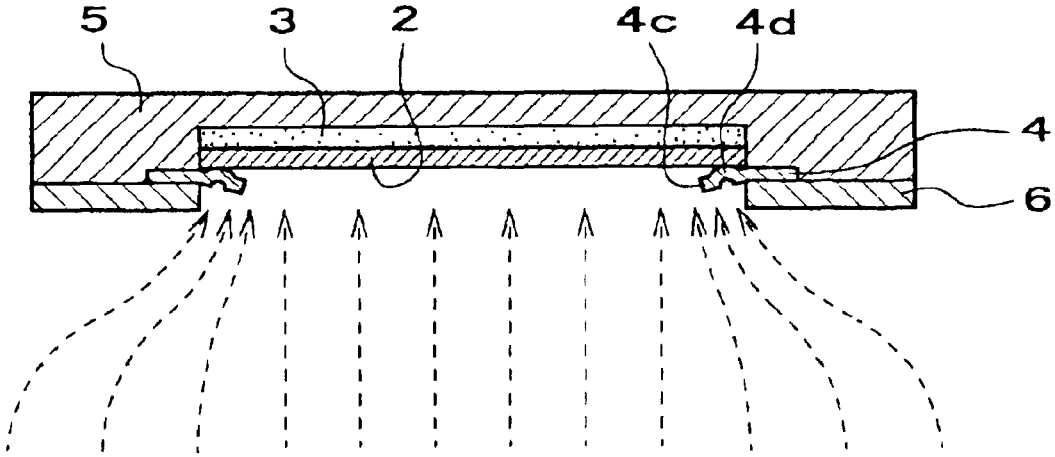

FIG. 8(*a*) is a sectional view taken on line F—F of FIG. 7(*a*), and FIG. 8(*b*) is a sectional view without a dummy plate taken on line F—F of FIG. 7(*a*). In FIG. 8, the arrows indicate the lanes of an electric force in the plating solvent.

In the case of not providing a dummy plate of a cathode, like in FIG. 8(*b*), the lines of an electric force in tie plating solvent enter intensively toward the plating department 2*a* from the side of the plating department 2*a*. Consequently, the thickness of the membrane around the plating department 2*a* tends to be increased. For this phenomenon, providing a dummy plate 7 like the present invention, the lines of an electric force approaching the plating department 2*a* from side directions are directed to a dummy plate as indicating in FIG. 8(*a*). Consequently, since only the lines of electric force approaching from forward enter into the plating department 2*a*, a uniform plating membrane can be named on the plating department 2*a*.

Next, the following is an explanation of the plating solvent bursting forth from around an inflow hole 15. As for electroplating, the plated base is a negative pole. A metallic positive ion in the plating solvent is attracted a negative pole for accumulating on the plating department. In time, since a metallic positive ion around the plating department 2*a* is easily attracted, the density of a positive ion around the plating department 2*a* becomes low as time goes by. At the same time, since the condition of plating is changed, the quality of plating is changed as time goes by. Furthermore, when a gaseous positive ion in the plating solvent is attracted to a negative pole, a bubble is yielded on the plating department. The bubbles cause heterogeneous plating because the current does not pass on an area a bubble is adhered to, and plating is suspended.

However, in the present invention, when a plating solvent burst flow around the plating department 2*a* for circulation, the density of a metals positive ion around the plating department 2*a* does not change as time goes by. Moreover, if a bubble adheres to a plating department 2*a*, the plating solvent draining powerfully to a plating department 21 is ash this bubble down. These agencies make it possible for the testing device of the present invention to stabilize a plating condition and to make a uniform membrane of the plating.

Above is an explanation of this illustrated embodiment; however, the testing device for electroplating of the present invention is not restricted to the illustrated embodiment.

For example, the method of using the testing device for electroplating of this embodiment may include equipping the device with a mixer for the plating solvent.

Figure 9A:
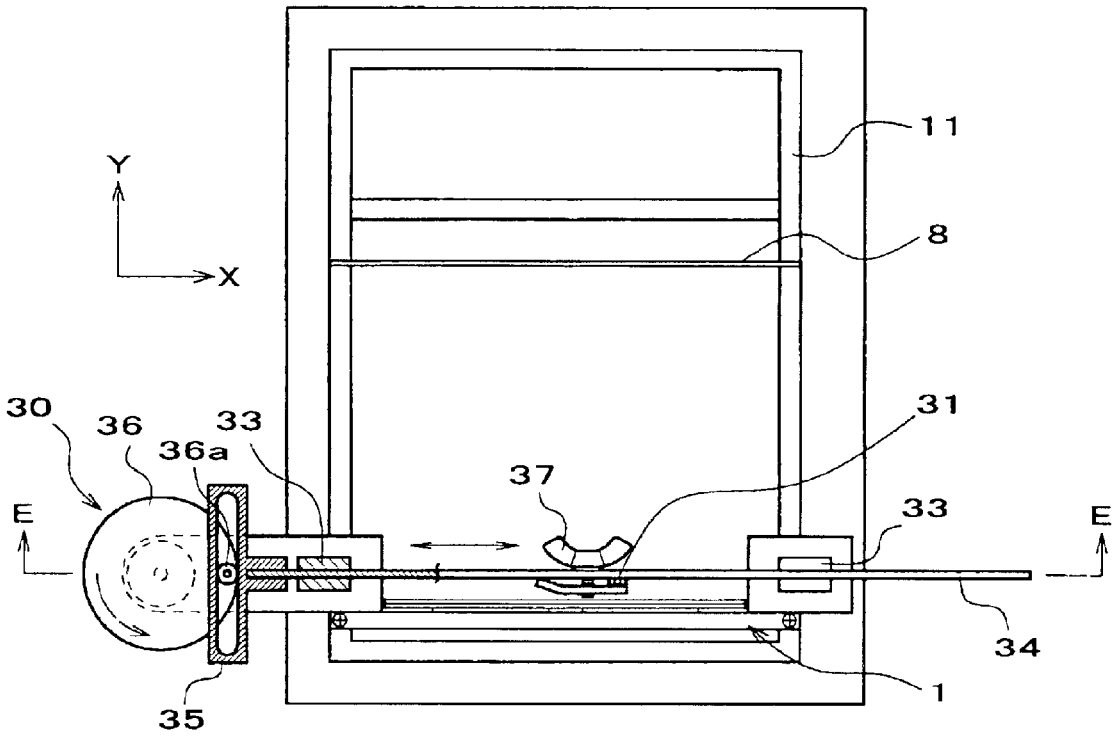
FIG. 9(*a*) is a top view of equipping a mixer for the plating solvent in the testing device for electroplating of the illustrated embodiment of this invention.
Figure 9B:
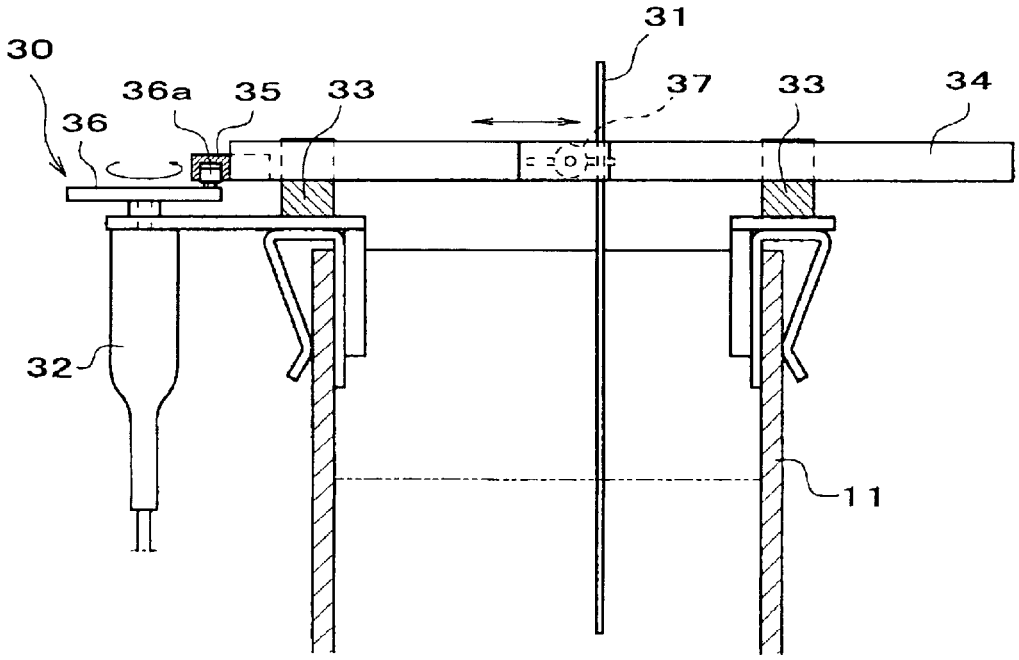

FIG. 9(*a*) is a top view of a testing device for electroplating equipped with a mixer for a plating solvent. FIG. 9(*b*) is a sectional view taken on line E—E of FIG. 9(*a*).

A mixer 30 for a plating solvent is to mix a plating solvent around a plating department 2*a* by imparting a reciprocate motion to a paddle 31 of a metallic stick having approximately 2 mm in a climate perpendicular to an as of the paddle along a plating department 2*a* on a peripheral of a plating department 2*a*. A paddle 31 is fixed in a slide shaft 34 with a screw 37, and the slide shaft 34 is capable for sliding on the slide rail 33 and a channel 33 in a direction X. A follower 35 with a channel in Y direction perpendicular to a slide shaft is fixed in an edge of another slide shaft 34 A roller pin 36*a* is embedded in channel of the follower 35, and the roller pin 36*a* is supported with universal function for revolution to a disk 36 in one area around the disk 36 rotated by a motor 32.

The constructed mixer 30 for plating solvent act as follow. When the motor 32 is run, the disk 36 fixed by the motor 32 rotation, the positions of X and Y of roller pin 36*a* in the disk are changed. The follower 35 can only move in X direction, since changing the Y position of the roller pin 36*a* is aspirated in a channel of the follower 35, the follower 35 performs a reciprocating motion in X direction in accordance with changing a position of X direction of the roller pin 36*a* in a channel. The slide shaft 34 and the paddle 31 are integrally fixed, and the paddle 31 performs a reciprocating motion in a X direction.

Since the mixer 30 for a plating solvent mixes powerfully around the plating department 2*a* in the above-described manner, the density of a metallic positive ion around the plating department 2*a* made invariable and adhered bubbles are removed from the plating department 2*a*. Accordingly, a uniform plating membrane can be obtained on the plating department 2*a*.

And as another example of a variation of the present invention, an insulted interceptor can be provided around a negative pole between the negative pole 1 and the positive pole 8.

Figure 10:
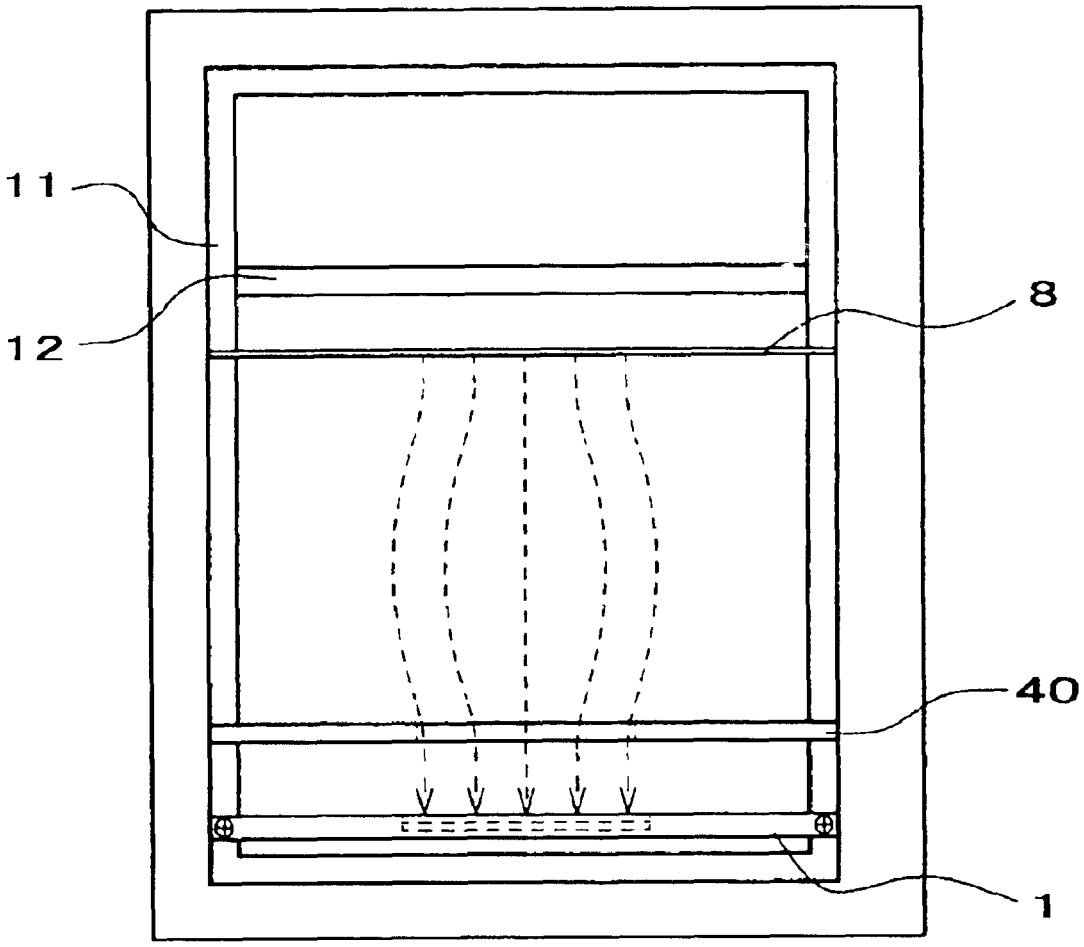
FIG. 10 is a top view of the testing device for electroplating equipped with a tubular inceptor that is an insulator around a negative pole between a cathode and an anode.

FIG. 10 is a top view of the testing device for electroplating equipped with an insulted interceptor around a negative pole 1 between a negative pole and a positive pole. In FIG. 10, the arrows indicate a currency of the lines of electric force in the plating solvent.

An interceptor 40 is an insulated plate which has a hole of a similar figure and slightly smaller than a plating department 2*a*, such as 5% smaller than a plating department 2*a*. This interceptor 40 is to be placed around a positive pole 1, such as the position of 10 mm ahead of the plating department 2*a* in order to put together a core point of hole both a plating department 2*a* and an interceptor 40.

Plating under these conditions cause the lines of an electric force, which go out from a positive pole, to enter into the plating department 2*a* uniformly, because when the lines of an electric force are about to enter into a plating department after spreading out in a side direction, the pathway is restricted by an interceptor 40. Consequently entering into a plating department 2*a* from a side of the plating department is impossible. That is why, a density of a currency in a plating department 2*a* becomes uniform, and a uniform plating membrane can be formed in a negative pole.

According to an above described embodiment of the invention, contacting the plating department with a cathode conductor is certainty, and a uniform plating membrane can be formed.

Furthermore, according to an embodiment of the invention, since the lines of electric force approaching a plating department from a side of the plating department can enter into a dummy plate, the lines of electric force enter into the plating department. Consequently a uniform plating membrane can be formed.

According to another embodiment of the invention, the density of a metallic positive ion around the plate department becomes invariable, and adhesion of a plating department can be removed. Consequently a uniform plating membrane can be formed.

What is claimed is:

1. A cathode cartridge of a testing device for electroplating, said cathode cartridge comprising:

a tabular cathode conductor having a front side and a back side and comprising an orifice having the same shape as a plated part of a plated base the tabular cathode conductor further comprising a plurality of protruding portions, the protruding portions press contacting a peripheral part around the plated part, said tabular cathode conduct further comprising an exposed portion not soaked in plating solution, the exposed portion being connectable with a direct current power supply;

a tabular rear insulator covering both a backside of the plated base and said backside of said cathode conductor, said tubular rear insulator having a recess into which the plated base and said cathode conductor are retained;

a tabular front insulator having an orifice having the same shape as the plated part, said tabular front insulator covering said front side of said cathode conductor;

an elastic thin board sandwiched between the plated base and said tabular rear insulator;

a dummy plate as a conductor, the dummy plate having an orifice having the same shape as the plated part of the plated base, said dummy plate being provided outside of said tabular front insulator and being connectable with the direct current power supply to be a negative pole, wherein each of said protruding portions is formed with a single contact point for contacting said peripheral part.

2. A cathode cartridge according to claim 1, wherein said cathode conductor further comprises a plurality of contact flakes and said plurality of protruding portions are formed on the contact flakes.

3. A cathode cartridge of a testing device for electroplating, said cathode cartridge comprising:

a tabular cathode conductor having a front side and a back side, said tabular cathode conductor comprising a ring portion having an inner periphery and an outer periphery, a plurality of contact flakes extending radially inward from said inner periphery, a plurality of protruding portions situated on said contact flakes for press contacting a peripheral portion of the plated part, and an exposed conductor portion extending from said outer periphery of said ring portion, said ring portion including an orifice having the same shape as a plated part of a plated base, said exposed conductor portion not being soaked in plating solution and being connectable with a direct current power supply, a tabular rear insulator covering both a backside of the plate base and said backside of said cathode conductor, said tubular rear insulator having a recess for retaining the plated base and said cathode conductor;

a tabular front insulator having an orifice having the some shape as the plated part, said tabular front insulator covering said front side of said cathode conductor; and an elastic thin board interposable between the plated base and said tabular rear insulator, wherein each of said protruding portions is formed with a single contact point for contacting said peripheral part.

4. A cathode cartridge according to claim 3, further comprising a dummy plate as a conductor, the dummy plate including an orifice having the same shape a the plated part of the plated base, said dummy plate being provided outside of said tabular front insulator and being connectable with the direct current power supply to be a negative pole.

5. A cathode cartridge according to claim 3, wherein each of said protruding portions comprises a pointed tip defining said single contact point for press contacting with the peripheral portion of the plated part.

* * * * *